United States Patent [19]

Litman

[11] 4,114,302

[45] Sep. 19, 1978

[54] MOUNTING ARRANGEMENT FOR A RIFLE SCOPE

[75] Inventor: Alan Litman, Pittsburgh, Pa.

[73] Assignee: Smith & Wesson Chemical Company, Inc., Pittsburgh, Pa.

[21] Appl. No.: 806,248

[22] Filed: Jun. 13, 1977

[51] Int. Cl.[2] ..... F41G 1/38

[52] U.S. Cl. ..... 42/1 ST; 33/248

[58] Field of Search ..... 42/1 ST; 33/245, 247, 33/248

[56] References Cited

U.S. PATENT DOCUMENTS

| | | | |
|---|---|---|---|
| 906,751 | 12/1908 | Swasey | 33/248 |
| 1,376,992 | 5/1921 | Amigues | 33/248 |
| 2,018,960 | 10/1935 | Kuhn | 33/248 |
| 2,103,539 | 12/1937 | Kuhn | 42/1 ST |
| 3,471,932 | 10/1969 | Luning | 42/1 ST |

FOREIGN PATENT DOCUMENTS

| | | | |
|---|---|---|---|
| 1,179,134 | 10/1964 | Fed. Rep. of Germany | 42/1 ST |

*Primary Examiner*—Charles T. Jordan
*Attorney, Agent, or Firm*—Patrick J. Walsh

[57] ABSTRACT

Disclosed is an arrangement for mounting a rifle scope on a rifle barrel. The mounting includes a base having a pair of coplanar plates pivoted to one another about a vertical axis at one end and biased for movement away from one another. To one side of one plate is a mounting foot for securing the scope on the rifle. The other plate has an upstanding arcuate saddle received about a cylindrical body portion of the scope, the distal ends of the saddle being pivoted to the scope about a horizontal axis. An azimuth adjustment device serves to adjust the angle of the plates relative to one another about the vertical axis. An elevation adjustment device lies to one side of the scope above its base for adjusting the angle of the scope about the horizontal axis relative to the base. By offsetting both the elevational and azimuth adjustment devices, the foregoing mounting structure enables the scope to lie in close superposition to the rifle barrel.

13 Claims, 7 Drawing Figures

MOUNTING ARRANGEMENT FOR A RIFLE SCOPE

The present invention relates to an arrangement for mounting a rifle scope on a rifle and particularly relates to a mounting arrangement enabling the scope to lie in close superposition to the rifle barrel while also providing for built-in azimuth and elevation adjustment.

Arrangements for mounting scopes, for example night vision scopes on the barrels of rifles, have been proposed and constructed in the past. These scopes, however, because of the necessary azimuth and elevational adjustments are normally mounted high on the rifle barrel. That is, the center line of these scopes have been known to be located as high as 3½–4 inches off the rifle barrel and higher. This high mounting is undesirable since it requires necessary adjustment and renders the rifle and scope very cumbersome when being handled.

Also, the biasing mechanisms in prior azimuth and elevation adjusting devices for scopes often use springs which are somewhat bulky and exacerbate the problem of mounting the scope low on the rifle barrel. That is, the dimensions of these springs thus prevent mounting the scope low on the rifle.

Accordingly, it is a primary object of the present invention to provide a novel and improved arrangement for mounting a rifle scope on a rifle barrel.

It is another object of the present invention to provide a novel and improved arrangement for mounting a rifle scope on a rifle barrel wherein the scope is mounted in close superposition on the rifle barrel, for example with its centerline less than about 2 inches off the rifle barrel.

It is still another object of the present invention to provide an arrangement for mounting a rifle scope on a rifle barrel having novel and improved azimuth and elevational adjustment devices.

It is a further object of the present invention to provide a novel and improved arrangement for mounting a rifle scope on a rifle barrel having springs and arrangements thereof for use in connection with the azimuth and elevational adjustments facilitating low mounting of the scope on the rifle barrel.

It is a related object of the present invention to provide a novel and improved arrangementfor mounting a rifle scope on a rifle barrel wherein the mounting arrangement is simple and economic in construction.

To achieve the foregoing objects and advantages in accordance with the purpose of the present invention, as embodied and broadly described herein, the arrangement for mounting the rifle scope on a rifle barrel includes a base having first and second substantially side-by-side coplanar plates, means for pivotally securing the plates one to the other for movement of the first plate relative to the second plate in a generally horizontal direction and about a first axis generally normal to the plane containing the plates, means for adjusting the angular relation of the first plate relative to the second plate, an elongated mounting foot carried by the second plate on the side thereof remote from the first plate for mounting the scope on top of the rifle, the mounting foot being centrally located below the scope and substantially in the plane of the first and second plates, a saddle or cradle upstanding from the first plate and having an arcuate portion concentric with the cylindrical midbody of the scope along its underside, means at the opposite ends of the arcuate portion for pivotally mounting the scope on the base for movement about a second axis normal to the first axis and generally parallel to the plane of the base, and means for pivoting the scope about the second axis to adjust the scope in elevation relative to the base, the elevation adjustment means being located laterally of the scope and above the base.

Preferably, each of the azimuth and elevational adjustment devices includes a pair of generally U-shaped springs disposed in coplanar relation one to the other with their near legs secured one to the other and their opposite legs secured to the respective elements being biased apart. In this manner, the U-shaped springs in the base used for adjustment in azimuth occupy minimum height and facilitate low mounting of the scope on the rifle barrel. In addition, the U-shaped springs used for adjustment in elevation are located along the side of the rifle scope further to facilitate low mounting of the scope on the rifle barrel.

The foregoing and other objects and advantages of the present invention will become more apparent upon reference to the following specification, appended claims and drawings wherein:

Figure 1:
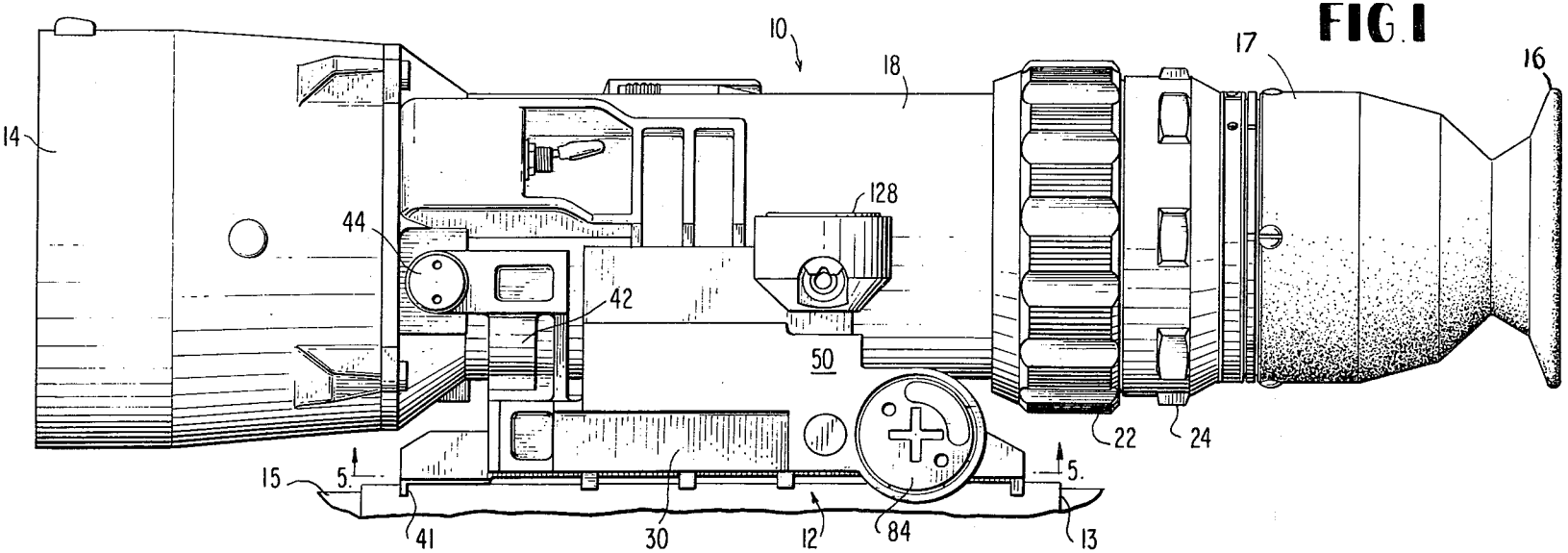
FIG. 1 is a side elevational view of a rifle scope illustrating an arrangement for mounting the scope on a rifle in accordance with the present invention.
Figure 2:
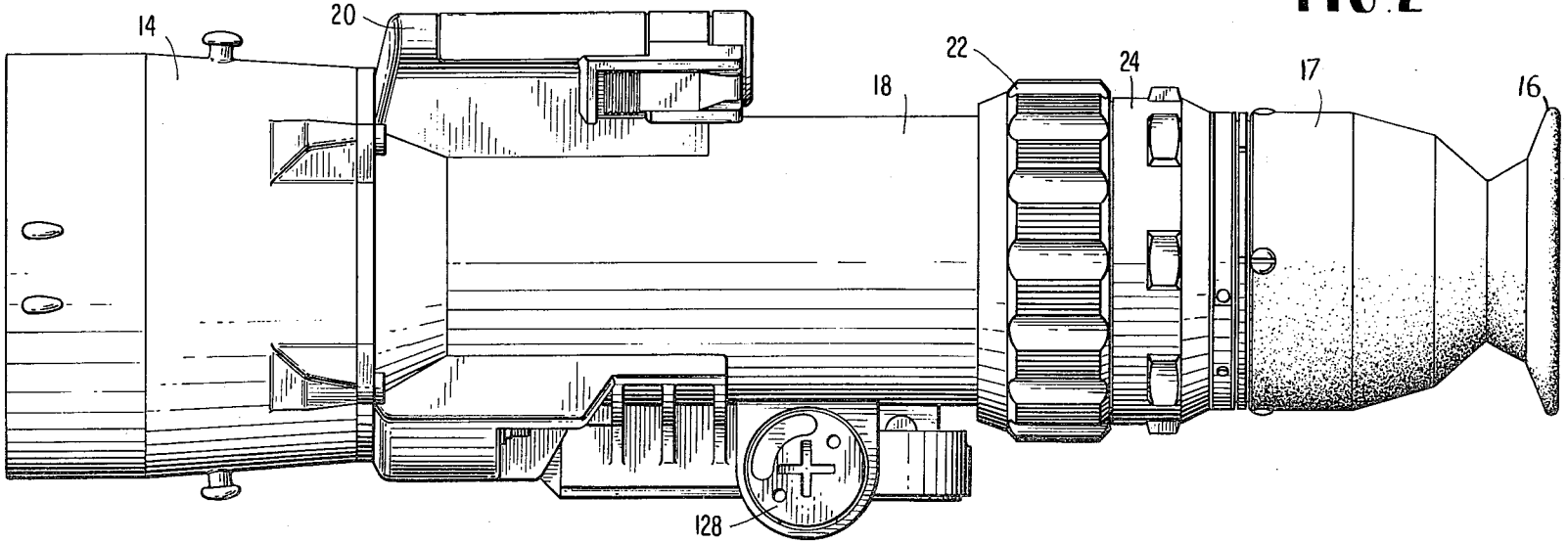
FIG. 2 is a plan view of the rifle scope illustrated in FIG. 1.
Figure 3:
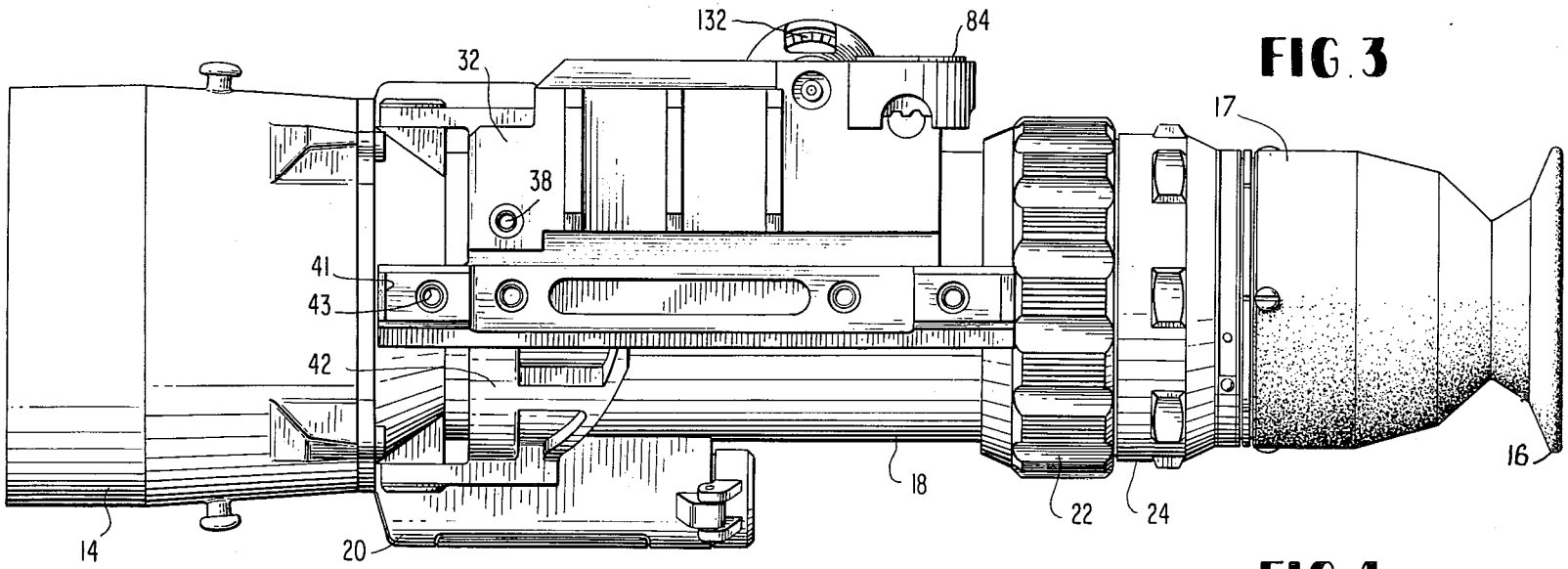
FIG. 3 is a bottom plan view of the rifle scope illustrated in FIG. 1.
Figure 4:
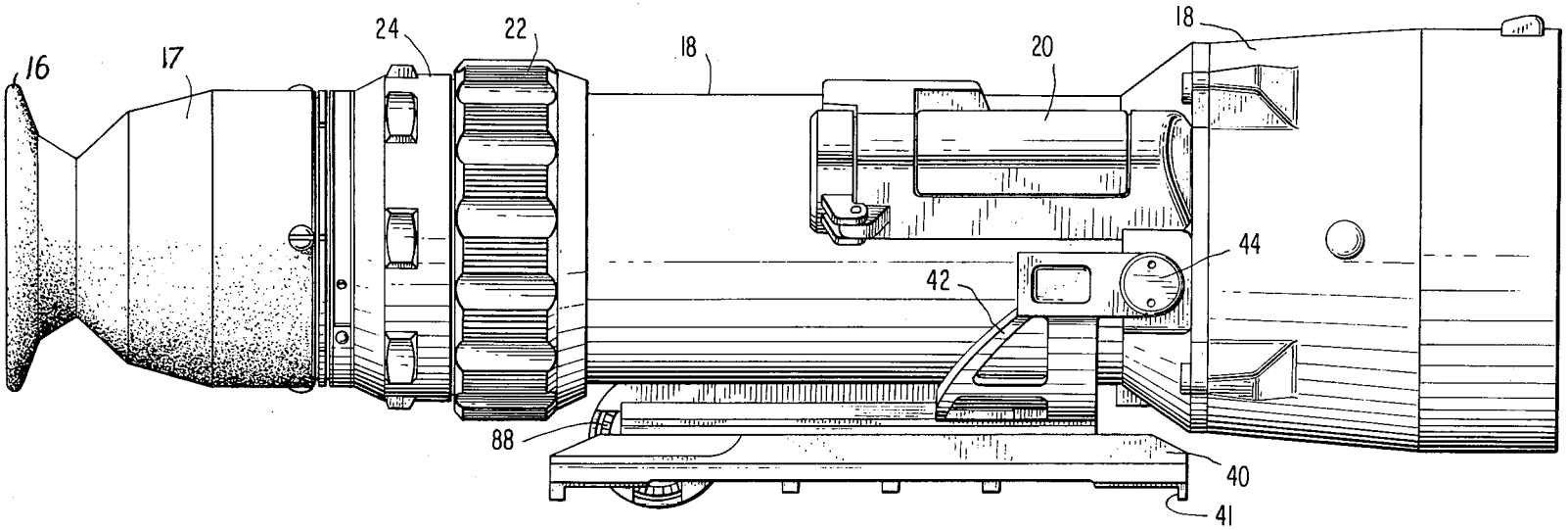
FIG. 4 is a side elevational view of the rifle scope similarly illustrated in FIG. 1 but taken from its opposite side.

Reference will now be made in detail to the present preferred embodiment of the invention, an example of which is illustrated in the accompanying drawings.

Referring now to drawing FIGS. 1–4, there is illustrated an optical instrument, in this instance a night vision scope generally designated 10, having a mounting designated 12 whereby the scope can be secured to a standard mounting adaptor 13 carried on a rifle barrel designated 15. The night vision device 10 includes an objective lens 14 at one end and an eyepiece 16 and ocular 17 at its opposite end. Intermediate objective lens 14 and ocular 17 is an intermediate cylindrical body 18 housing an intensifier tube, not shown. The intensifier tube may comprise a photomultiplier powered by a battery, not shown, disposed in a battery housing 20 carried by body 18. A ring 22 for focusing the objective lens and intensifier tube relative to one another and a ring 24 for focusing the ocular and the intensifier tube relative to one another are provided. Since the night vision scope per se forms no part of the present invention, further description of the scope per se is not believed necessary. It is believed sufficient, with the foregoing, to note that the scope is intended for mounting on top of the rifle barrel in close superposition thereto and that the scope is adjustable in azimuth and elevation by mechanisms forming part of the mounting 12 as will now be described.

Figure 5:
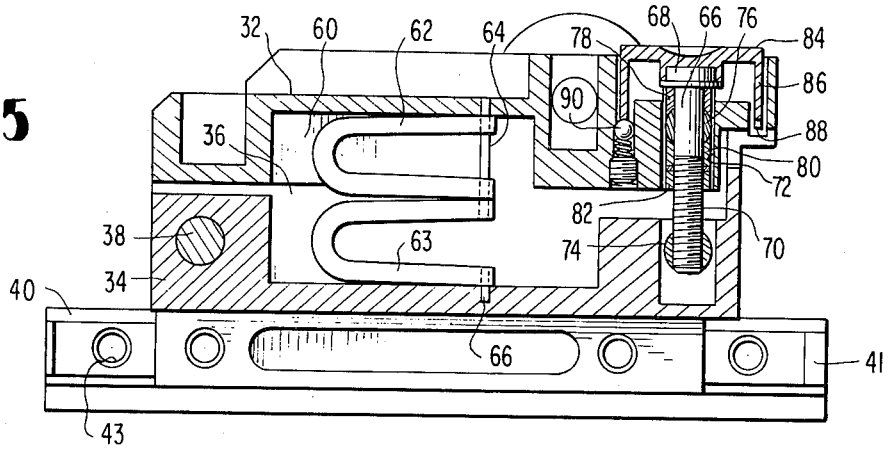
FIG. 5 is a longitudinal cross-sectional view through the base of the mounting arrangement for the scope illustrated in FIG. 1 and taken generally about on line 5—5 in FIG. 1.
Figure 7:
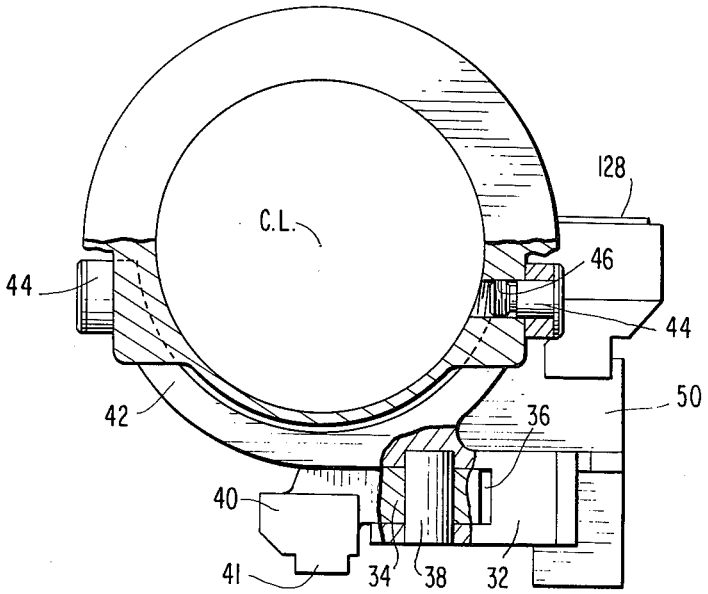
FIG. 7 is an end elevational view of the mounting arrangement with parts broken out and in cross-section and particularly illustrating the saddle for the scope.

Turning now to FIGS. 5 and 7, mount 12 comprises a base 30 including a first base plate 32 and a second base plate 34 substantially coplanar with base plate 32, both plates 32 and 34 extending generally horizontally. First plate 32 has a recess 36 which opens laterally toward second base plate 34. A lateral portion of base plate 34 extends within recess 36 and a pin 38 pivots plates 32 and 34 one to the other. Pin 38 is disposed at one end of plates 32 and 34 and the plates are thus angularly adjustably related one to the other about the axis of pin 38 which extends vertically, i.e., normal to the plane containing plates 32 and 34.

On the side of plate 34 remote from plate 32, there is provided an elongated mounting foot 40 having a plurality of threaded openings 43 spaced longitudinally one from the other along its length for securing the mount and scope to the mounting adaptor 13 carried by the rifle barrel 15. It will be appreciated that mounting foot 40 carries a pair of detents 41 at its opposite ends for engaging in slots, not shown, formed in the mounting adaptor 13 whereby the scope can be secured to the rifle barrel in a fixed stabilized position. Also, from a review of FIG. 7, it would be appreciated that mounting foot 40 lies directly below the center line C.L. of the scope while the plates 32 and 34 are located laterally to one side of the scope.

Carried adjacent to and upstanding from the forward end of plate 32 is an arcuate saddle or cradle 42 having a curvature concentric with the curvature of the body 18 of scope 10. The distal ends of the saddle 42 carry pins 44 which are received in openings 46 in the side of the scope whereby scope 10 is pivotable about the horizontal axis defined by mounting pins 44. Base plate 32 has an upward extension 50 to one side of mounting 12, extension 50 having laterally spaced, opposed side walls defining an upwardly opening recess 52. A housing 54 is secured to the body 18 of scope 10 and projects laterally to the same side of scope 10 as extension 50. Housing 54 has a downwardly opening recess 56 for purposes explained in the ensuing description. The lower portion of housing 54 is received in the upwardly opening recess 52 of extension 50.

Turning now to FIG. 5, mount 12 carries an azimuth adjustment mechanism whereby the scope is adjustably pivoted about the vertical axis of pin 38 and retained in its adjusted position. The accomplish this, plate 32 has a recess 60 opening to one side thereof and toward recess 36 in laterally opposed plate 34 whereby recesses 36 and 60 form a chamber. A pair of generally U-shaped springs 62 and 63 are disposed within the chamber in coplanar relation one to the other and to the base of mounting 12. A pin 64 extends through the side wall of plate 32 and through the ends of the legs of spring 62 and into the end of the adjacent leg of spring 63. A pin 66 couples the remote leg of spring 63 to the opposite wall of plate 34. Springs 62 and 63 lie coplanar one with the other, i.e., in a horizontal plane, and are confined within the chamber defined by recesses 36 and 60 by the top and bottom walls thereof as well as by the opposed side and end walls of plates 32 and 34. Springs 62 and 63 bias plate 32 for angular movement about pivot pin 38 away from plates 34 and 63. It will be appreciated that the scope is secured to plate 32 by saddle 42 and thus will follow the horizontal or azimuth adjustment upon rotation of plate 32 relative to plate 34.

To restrain plate 32 against the bias of spring 62 and maintain the scope in an adjusted position, a bolt 66 having a head 68 and a threaded portion 70 is received through a bore 72 in the side of base plate 32. Bolt 66 is threaded into a pin 74 disposed in a vertical bore in plate 34, pin 74 thus extending perpendicular to bolt 66. Bolt 66 in plate 32 also extends through a pin 76 which extends perpendicular to bolt 66 in plate 32 and suitable spacers 78 and 80 are disposed on opposite sides of pin 76. A nut 82 is screw threaded on bolt 66 and rotates therewith. Nut 82 together with the spacers 78 and 80 and the head of bolt 66 maintain bolt 66 in fixed axial position relative to pin 76 and plate 32.

About the head 68 of bolt 66, there is provided an azimuth adjusting screw cap 84 having a depending skirt 86. The marginal edge of skirt 86 has a sawtooth edge 88 which, as cap 84 rotates, engages a spring biased ball 90 to provide a click stop.

In order to adjust the scope in azimuth, bolt 66 is unthreaded from pin 74. This permits springs 62 and 63 to bias the plate 32 for pivotal movement about the vertical axis of pin 38 in a lateral direction away from plate 34. Since bolt 66 is fixed in axial position relative to plate 32, plate 32 pivots outwardly only to the extent bolt 66 is unthreaded from pin 74 in plate 34. Conversely, the threading action of bolt 66 into pin 74 displaces plate 32 for pivotal movement inwardly toward plate 34 and against the bias of springs 62 and 63.

Figure 6:
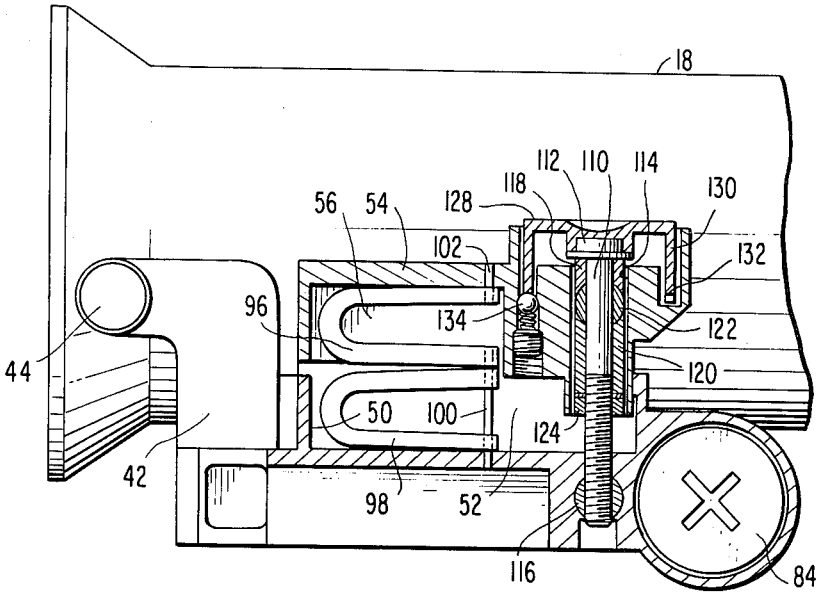
FIG. 6 is a fragmentary longitudinal cross-sectional view through the mounting arrangement illustrating the elevational adjustment for the scope.

Turning now to FIG. 6, a somewhat similar mechanism is provided to adjust the scope in elevation. Particularly, upwardly and downwardly opening recesses 52 and 56, respectively, in extension 50 and housing 54 define a chamber which receives a pair of generally U-shaped springs 96 and 98. The springs 96 and 98 lie in a common, substantially vertical, plane and a pin 100 extends upwardly through the lower wall of extension 50 and through the legs of lower spring 98 and the adjacent leg of upper spring 96. A pin 102 extends through the upper wall of housing 54 into the end of the opposite leg of spring 96. Thus, springs 96 and 98 are constrained in a coplanar, vertically superposed, relationship with one another and bias the housing 54 in a direction away from extension 50. Since extension 50 forms part of base 30 which, in turn, pivotally carries scope 10 about pins 44, movement of housing 54 relative to extension 50 causes scope 10 to pivot about pins 44, i.e., pivot about the general horizontal axis defined by pins 44 for adjustment in elevation.

To maintain scope 10 in adjusted elevation, an elevation adjustment bolt 110 having a head 112 extends through a bore 114 in housing 54. The threaded end of bolt 110 is threadedly received in a pin 116 which extends perpendicular, i.e., horizontal, to bolt 110 in base plate 32. Spacers 118 and 120 lie on opposite sides of a pin 122 which extends horizontally through housing 54 and which receives the shank of bolt 110. A nut 124 is threadedly received for rotation with bolt 110 whereby bolt 110 is clamped against axial movement in housing 54 by means of its head 112, spacers 118 and 120 and pin 122.

The upper end of bolt 110 has an elevation adjustment screw cap 128 having a depending skirt 130. The margins of depending skirt 130 have a sawtooth pattern 132 and cooperate with a spring biased ball 134 seated in housing 54 to provide a click stop.

Thus, to adjust the scope in elevation, screw cap 128 is turned to rotate bolt 110. Bolt 110 is thus threaded relative to pin 116 in one direction whereby springs 96 and 98 bias the housing 54 upwardly to pivot scope 10 about the horizontal axis defined by pins 44 and away from base 30. By threading bolt 110 in an opposite direction, housing 54 and hence scope 10 is pivoted about the horizontal axis of pins 44 in a direction toward the base and against the bias of springs 96 and 98. As in the azimuth adjustment mechanism, bolt 110 is fixed axially relative to housing 54 during adjustment.

Thus, it will be appreciated that the objects of the present invention are fully accomplished in that there has been provided a mounting arrangement for a night vision scope wherein the scope is mounted in close superposition to the rifle barrel. Also, the mounting arrangement includes azimuth and elevation adjustment mechanisms mounted on one side of mount 12 and this, together with the saddle arrangement, facilitates the low mount of the scope on the rifle barrel.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the means and range of equivalency of the claims are therefore intended to be embraced therein.

I claim:

1. An arrangement for mounting a rifle scope having a cylindrical body portion on a rifle barrel comprising:

a base including first and second substantially side-by-side coplanar plates, means for pivotally securing said plates one to the other for movement of said first plate relative to said second plate in a generally horizontal direction about a first axis generally normal to the plane containing said plates;

means for moving said first plate relative to said second plate for adjusting the angular relation between said plates;

an elongated mounting foot carried by said second plate on the side thereof remote from said first plate for mounting the scope on top of the rifle barrel, said mounting foot lying substantially centrally below the scope and substantially in the plane of said first and second plates;

a saddle upstanding from said first plate and having an arcuate portion generally concentric with the cylindrical body portion of the scope and located along its underside;

means at the opposite ends of said arcuate portion for pivotally mounting the scope relative to said base for movement about a second axis normal to said first axis and generally parallel to the plane of said base; and means carried by said first plate for pivoting the scope about said second axis to adjust the scope in elevation relative to said base, said elevation adjustment means being located laterally of the scope and above said base.

2. A mounting arrangement according to claim 1, wherein one of said first and second plates has a recess opening to one side thereof, the other of said first and second plates being received within said recess.

3. A mounting arrangement according to claim 2, wherein said other plate has a recess opening to one side thereof towards said one plate and in opposition to the recess in said one plate to define a chamber therewith, means for biasing said first and second plates for separating movement relative to one another about said first axis, said adjusting means including means for restraining said separating movement of said plates.

4. A mounting arrangement according to claim 3, wherein said biasing means includes at least one generally U-shaped spring disposed in said chamber in the plane of said plates.

5. A mounting arrangement according to claim 4 wherein said biasing means includes a pair of generally U-shaped springs disposed in said chamber in side-by-side coplanar relation one to the other and to said plates with the near legs of said springs engaging one another and the remote legs bearing against said first and second plates, and means for retaining said near legs in engagement one with the other.

6. A mounting arrangement according to claim 5 wherein said adjusting means includes a bolt through said first plate and screw threaded to said second plate, means for retaining said bolt against axial displacement in said first plate upon threading action thereof in said second plate whereby said bolt maintains its axial position relative to the first plate upon movement of said first plate about said first axis relative to said second plate.

7. A mounting arrangement according to claim 1 wherein said first axis is laterally offset from said mounting foot whereby the centerline of the scope and first axis are laterally offset one from the other.

8. A mounting arrangement according to claim 1 wherein said elevation adjustment means includes a housing carried by the scope and an upwardly extending extension carried by said first plate, means cooperable between said housing and said extension for biasing said housing and said extension for separating movement relative to one another about said second axis, said elevation adjustment means including means for restraining the separating movement of said housing and said extension.

9. A mounting arrangement according to claim 8 wherein one of said housing and said extension has a recess opening toward the other of said housing and said extension, the other of said housing and said extension being received within said recess.

10. A mounting arrangement according to claim 9 wherein the other of said housing and said extension has a recess opening toward said one of said housing and said extension in opposition to the recess in the other of said housing and said extension to define a chamber therewith, said biasing means including at least one generally U-shaped spring disposed in said chamber.

11. A mounting arrangement according to claim 10 wherein said biasing means includes a pair of generally U-shaped springs disposed in said chamber in superposed substantially vertical coplanar relation one to the other with the near legs of said springs engaging one another and the remote legs bearing against said housing and said extension, and means for retaining said near legs in engagement one with the other.

12. A mounting arrangement according to claim 11 wherein said adjusting means includes a bolt through said housing and screw threaded to said extension, means for retaining said bolt against axial displacement in said housing upon threading action thereof in said extension whereby said bolt maintains its axial position relative to said housing upon movement of said housing about said second axis relative to said extension.

13. A mounting arrangement according to claim 11 wherein one of said first and second plates has a recess opening to one side thereof, the other of said first and second plates being received within said recess, said other plate having a recess opening to one side thereof towards said one plate and in opposition to the recess in said one plate to define a chamber therewith, means for biasing said first and second plates for separating movement relative to one another about said first axis, said adjusting means including means for restraining said separating movement of said plates, said biasing means including a pair of generally U-shaped springs disposed in said chamber in side-by-side coplanar relation one to the other and to said plates with the near legs of said springs engaging one another and the remote legs bearing against said first and second plates, and means for retaining said near legs in engagement one with the other.

* * * * *